United States Patent [19]

Zeisler

[11] 4,291,418

[45] Sep. 29, 1981

[54] CRASH-HELMET

[76] Inventor: Kurt Zeisler, Buchenstrasse 4, 8351 Schwanenkirchen, Fed. Rep. of Germany

[21] Appl. No.: 75,735

[22] Filed: Sep. 14, 1979

[30] Foreign Application Priority Data

May 9, 1977 [DE] Fed. Rep. of Germany ..... 2720785

[51] Int. Cl.[3] ..... A42B 3/02

[52] U.S. Cl. ..... 2/410; 2/424

[58] Field of Search ..... 2/410, 424, 423, 5, 2/6, 171, 205

[56] References Cited

U.S. PATENT DOCUMENTS

| | | | |
|---|---|---|---|
| 544,832 | 8/1895 | Senior | 2/5 |
| 606,379 | 6/1898 | Dallinger | 2/5 |
| 2,861,272 | 11/1958 | Stuart et al. | 2/6 |
| 3,127,616 | 4/1964 | Schueller | 2/6 |

*Primary Examiner*—Peter P. Nerbun

*Attorney, Agent, or Firm*—Jay L. Chaskin

[57] ABSTRACT

Crash-helmet in the form of a bell-shaped hood with a visor covering the field of view and arranged above a chin guard, characterized in that the hood consists of at least two swivelling parts connected by means of a hinge arrangement and which can be interlocked by safety locking devices on the abutting surfaces.

6 Claims, 8 Drawing Figures

CRASH-HELMET

The invention relates to a crash-helmet in the form of a bell-shaped hood with a visor covering the field of view and arranged above a chin guard. The conventional safety helmets are designed so as to taper towards the open side in order to ensure that they lie satisfactorily on the cheek-bone and on the ears as well as sit in the nape of the neck, thereby preventing bruising in the event of an impact or collision. However, this tapering shape frequently causes difficulties when removing the helmet in the event of an accident, and force often has to be exerted, which seriously harms the injured person.

The object of the invention is to provide a crash-helmet that can be removed more easily.

This object is achieved if the hood consists of at least two swivelling parts connected by means of a hinge arrangement, and wherein the said parts can be mutually locked by safety locking devices on the abutting surfaces. The effect of this measure is that on releasing the safety locking devices the parts of the helmet can swivel apart and can thus be removed from the injured person without having to exert any force.

It is particularly advantageous if such a division into parts connected by a hinge arrangement is effected so that the upper, approximately hemisphericalshaped, section of the crash-helmet is not completely split and thereby its strength and rigidity is not impaired.

The invention will now be described hereinafter by means of several embodiments and with the aid of some diagrammatic drawings in which:

FIGS. 1, 3 and 5 are side views of the helmet, and FIGS. 2, 4 and 6 are corresponding front views of the helmet.

The crash-helmets as illustrated consist of a hood 1 having a visor 2 on the front of the helmet which is optionally covered by a window 3.

Figure 1:
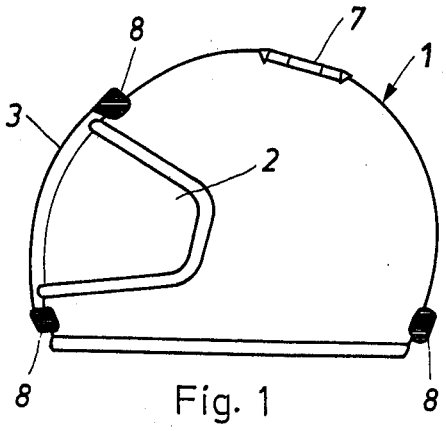
FIGS. 1 to 6 illustrate three embodiments of a crash-helmet according to the invention.
Figure 2:
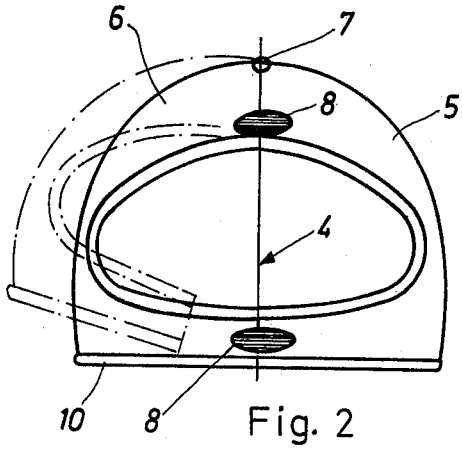

In the embodiment according to FIGS. 1 and 2 the helmet is divided in a vertex plane 4, i.e. in a vertical plane corresponding to the manner of use. The two hood halves 5 and 6 are joined together in an articulated manner on the upper vertex line by a hinge 7 and are mutually locked when the helmet is worn by means of safety locking devices 8, one being arranged on the rear of the helmet on the lower hood edge 10, and two above and below the visor. The helmet can swivel apart in the manner shown by the dotted lines in FIG. 2.

Figure 3:
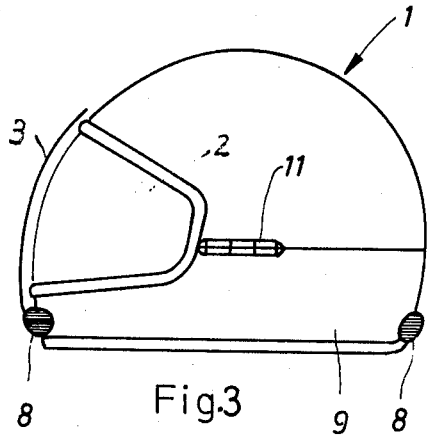
Figure 4:
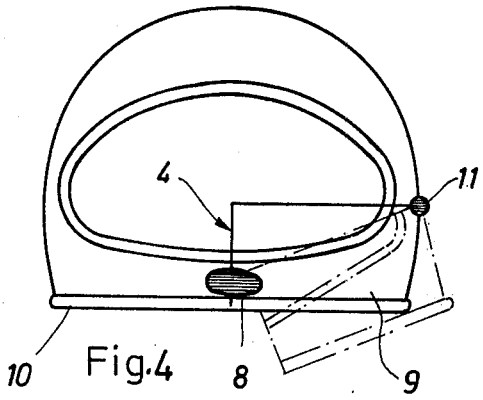

In the case of the embodiment shown in FIGS. 3 and 4, only a lower quarter section 9 of the hood can swivel. In this case the hood is divided at about a third of the height from the lower edge, i.e. approximately at the height of the auditory canal of the wearer at right angles to the vertex plane 4 up as far as this plane, and then in the vertex plane up as far as the free edge 10. The quarter-hood 9 thus obtained is held in the region of the ear by a hinge 11 and can be retained at the front and back of the vertex plane by safety locking devices 8. The swivelled-apart state is shown by dotted lines FIG. 4.

Figure 7:
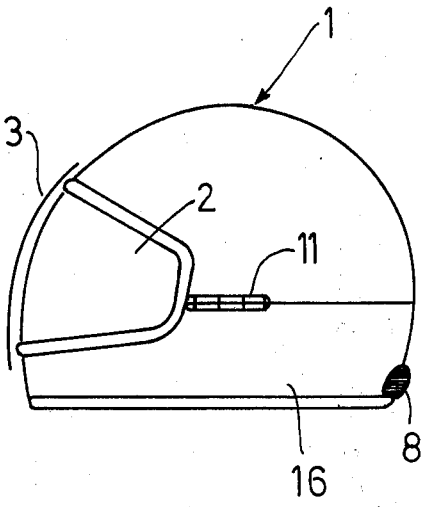
FIGS. 7 and 8 show a modification of the embodiment according to FIGS. 3 and 4.
Figure 8:
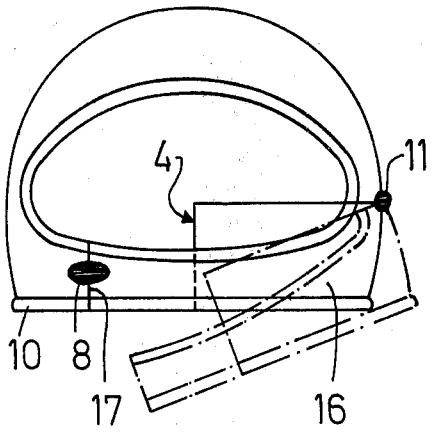

The embodiment according to FIGS. 7 and 8 differs from the embodiments according to FIGS. 3 and 4 merely by the fact that the front separation line 17 lies below the visor 2 not in the vertex plane, but shifted laterally towards the side of the vertex plane which is opposite to the hinge 11. This offers the special advantage that the chin region of the helmet which is particularly exposed to damage in the event of an accident is not weakened by a separation line. The swivelled apart state of the hood sector 16 is shown by dotted lines in FIG. 8.

Figure 5:
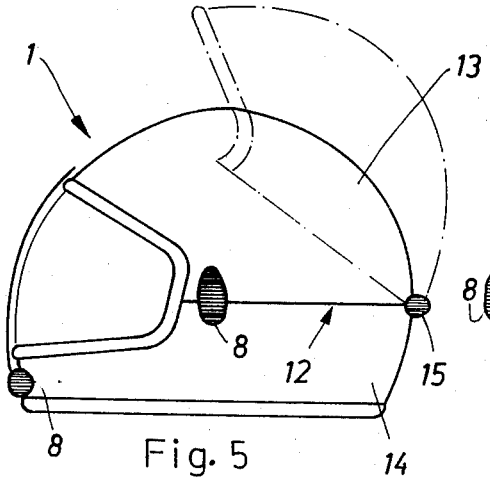
Figure 6:
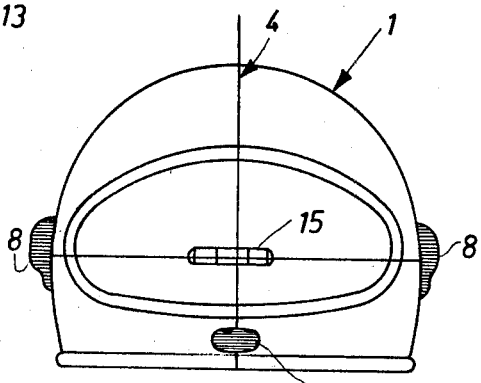

The helmet according to FIGS. 5 and 6 is completely divided by a transverse plane 12 at right angles to the vertex plane 4 and that lies horizontally when the helmet is worn. The two hood halves 13 and 14 are connected at the rear by a hinge 15 so that the shell- or hemispherical-shaped upper part 13 that absorbs the impact energy can be swivelled upwardly and to the rear. The parts are interlocked in the region of the ear. The lower hood part 14 is here additionally divided below the visor, in the vertex plane. The parts are interlocked by the safety locking devices 8. The swivelled apart state of the hood halves 13, 14 is shown by dotted lines in FIG. 5.

Various modifications in structure and/or function may be made by one skilled in the art to the disclosed embodiments without departing from the scope of the invention as defined by the claims.

What I claim is:

1. A crash helmet in the from of a substantially rigid one-piece bell-shaped hood having a head portion which extends to at least the height of the auditory canal, the hood having an integrally formed substantially rigid guard portion extending fully across the chin of the wearer and a visor for covering the field of view arranged above the chin guard portion, the hood comprising at least two swiveling parts connected by means of a hinge arrangement, the parts having at least one plane of separation through the chin guard portion, the parts being interlocked by means on the abutting surfaces of the parts and wherein the hood is separably divided at least on one side of a vertex plane and approximately at the height of the auditory canal by a transverse plane extending at a right angle to the vertex plane and between the vertex plane and the approximate auditory canal height, the approximate quarter hood sector obtained thereby swiveling about a hinge located at the approximate auditory canal height.

2. A crash helmet according to claim 1 wherein the entire hood is divided into separable parts approximately at the height of the auditory canal by a transverse plane extending at a right angle to a vertex plane, the parts swiveling about a hinge located at the rear of the hood and the locking means is located in the transverse plane at the abutting separable surfaces on each side of the vertex plane at the approximate auditory canal height.

3. A crash helmet according to claim 1 or 2 or 6 wherein the part of the hood lying below the transverse plane is separably divided in the vertex plane in the region of the chin guard portion and the locking means is located in the vertex plane at the abutting separable surfaces of the chin guard portion.

4. A crash helmet according to claim 1 wherein the hood is separably divided by a transverse plane extending at a right angle to a vertex plane and between the vertex plane and the approximate auditory canal height, one side of the hood being separably divided in the vertex plane and another substantially opposite side of the hood separably divided in a plane parallel to the vertex plane.

5. A crash helmet according to claim 4 wherein the parallel plane passes through the chin guard portion.

6. A crash helmet according to claim 1 wherein the locking means is located in the vertex plane at the abutting front separable surfaces below the visor and at the abutting rear surfaces at a lower hood edge.

* * * * *